United States Patent [19]

Kincaid

[11] 4,210,119

[45] Jul. 1, 1980

[54] SHEET METAL FIREPLACE STOVE WITH IMPROVED DRAFT

[76] Inventor: Duane P. Kincaid, Rte. 1, Box 471, Sandpoint, Id. 83864

[21] Appl. No.: 813,580

[22] Filed: Jul. 7, 1977

[51] Int. Cl.[2] ..... F24C 1/14

[52] U.S. Cl. ..... 126/61; 126/200

[58] Field of Search ..... 126/6, 60, 61, 63, 66, 126/67, 121, 200, 140; D23/97, 105

[56] References Cited

U.S. PATENT DOCUMENTS

| | | | |
|---|---|---|---|
| 1,135,478 | 4/1915 | Wood | 126/61 |
| 2,814,287 | 11/1957 | Shults | 126/140 |
| 3,457,907 | 7/1969 | Brunig | 126/140 |
| 3,757,766 | 9/1973 | Stevenson | 126/200 X |
| 3,986,488 | 10/1976 | Hannebaum | 126/60 X |
| 4,007,726 | 2/1977 | Kenchel | 126/67 |
| 4,027,649 | 6/1977 | Jackson | 126/4 |
| 4,095,581 | 6/1978 | Billmeyer et al. | 126/121 |
| 4,121,560 | 10/1978 | Knight | 126/121 X |

FOREIGN PATENT DOCUMENTS

| | | | |
|---|---|---|---|
| 531426 | 1/1922 | France | 126/200 |
| 885343 | 9/1943 | France | 126/67 |

*Primary Examiner*—Albert J. Makay
*Assistant Examiner*—Harold Joyce
*Attorney, Agent, or Firm*—Sughrue, Rothwell, Mion, Zinn and Macpeak

[57] ABSTRACT

A fireplace stove includes a sheet metal fire box of octagonal vertical cross-section incorporating on its front side a sheet metal front window assembly including a tempered glass window with a sliding shut-off plate insertably mounted just behind the window and between the glass window and a convection draft area formed by a horizontal draft channel which underlies the front window assembly. A draft slide bar underlies a fixed grill within the front window assembly box frame above the glass window and between the window and the fire box. A motor driven fan supplies air within an air flow passage defined by the backsplash plate vertically mounted to the stove and the rear of the stove to cause forced air flow upwardly between the vertical rear wall of the fire box and the backsplash plate to effect heat transfer by convection and downwardly within an air flow channel defined by the bottom horizontal walls of the fire box to maintain the floor which underlies the fireplace stove relatively cool.

8 Claims, 5 Drawing Figures

FIG. 4
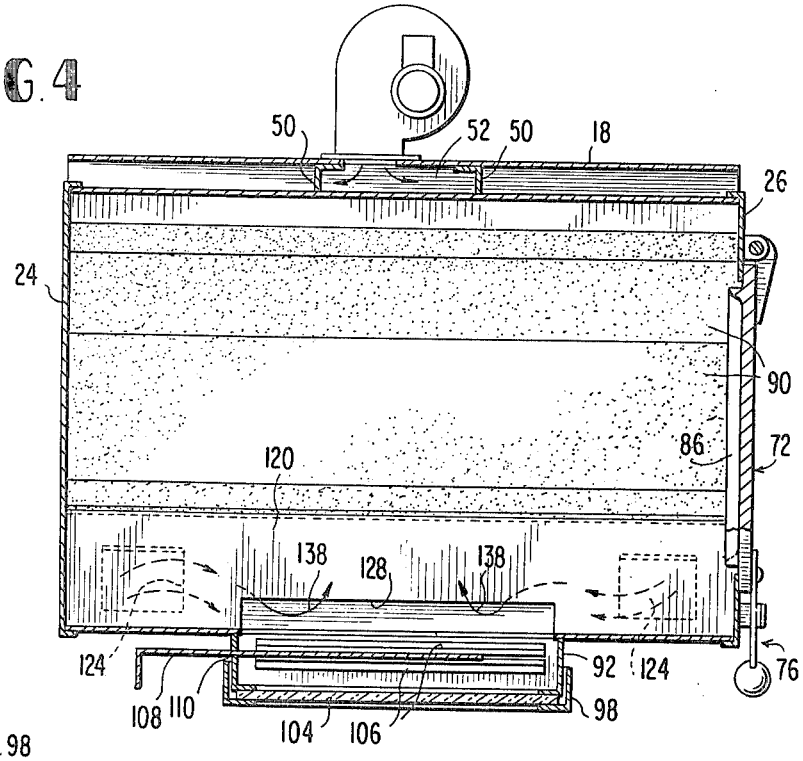
FIG. 5
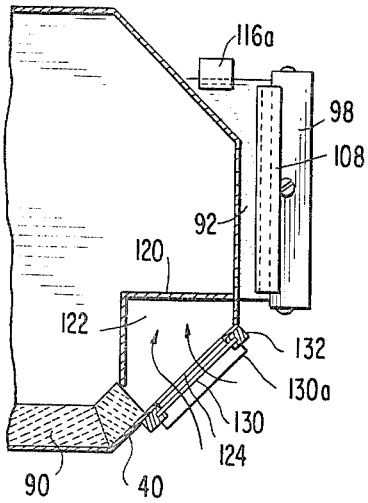
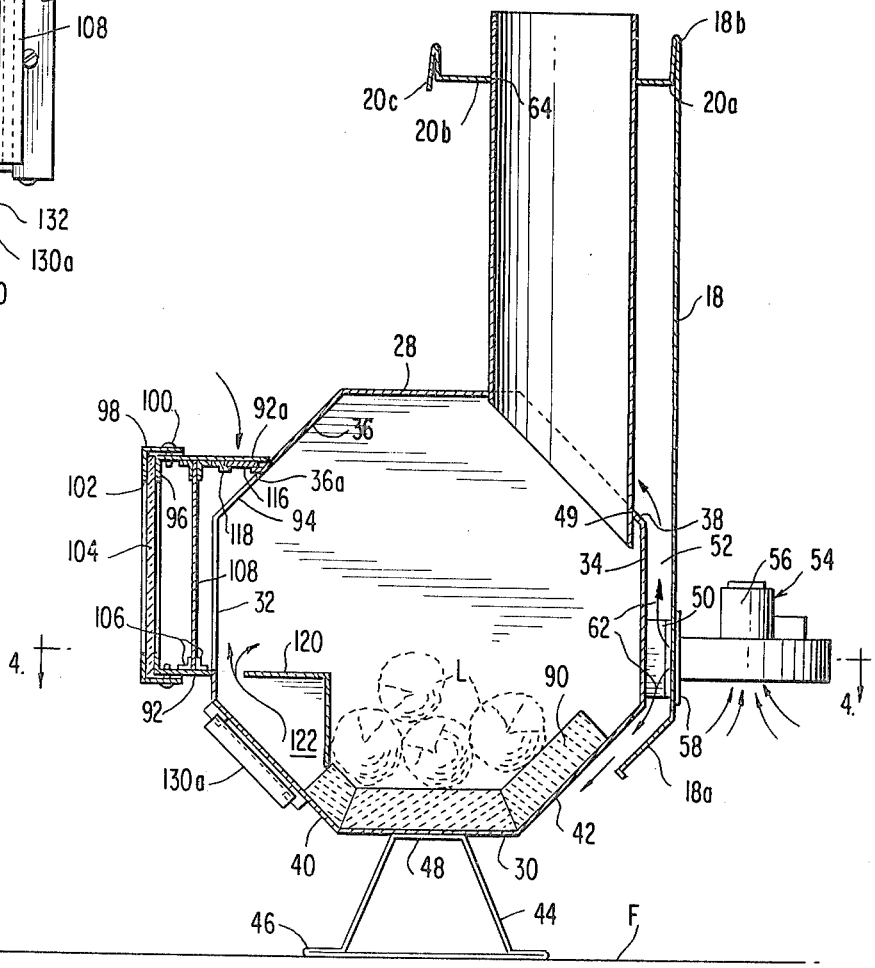
FIG. 3

SHEET METAL FIREPLACE STOVE WITH IMPROVED DRAFT

BACKGROUND OF THE INVENTION

FIELD OF THE INVENTION

This invention relates to small, low cost wood or coal burning stoves which also function as a fireplace permitting viewing of the fire within the fire box, cooking of food or the like on a flat horizontal wall of the stove above the fire, and reflection and convection of heat from the stove fire box into the room within which the stove is positioned.

With the recent increase in liquid petroleum fuel prices, public attention has shifted back to the utilization of wood burning stoves or heaters as the means for heating individual rooms and for the cooking of food. Such stoves and heaters are also employed in heating of vacation homes, hunting camps, temporary dwellings, and of permanent buildings where such buildings do not have access to liquid or gas fuels or where firewood is abundantly plentiful. Particularly in contemporary homes, such as A-frames, sheet metal fireplaces are in vogue wherein the fireplace is formed of relatively thin gauge sheet metal such as steel and the fire box is vertically supported at some distance from the floor, in some cases simply suspended from the ceiling by way of the flue stack which permits the heat from the burning logs within the fire box to radiate into the room within which the fireplace is mounted, while at the same time the occupants may view the wood as it burns through a side opening of the fire box.

While some of the fireplace heaters and cooking stoves have adequately performed their individual functions, such stoves have not functioned satisfactorily as fireplace heaters in that the interior of the fire box is normally hidden from view, while the fireplace heaters which permit the viewing of the burning of the logs through the open sidewalls, are not particularly effective and efficient, either in burning of the logs or radiation of the heat into the room within which the fireplace heater is mounted.

It is, therefore, an object of the present invention to provide a low cost, sheet metal fireplace stove which is highly efficient in terms of obtaining useful heat from the logs or coal burned within the stove.

It is a further object of this invention to provide an improved fireplace stove in which the combustion air being directed to the fire box at the base of the flame cools a tempered glass plate which overlies a front opening within the sheet metal fire box prior to its being utilized at the combustion area within the fire box.

It is a further object of this invention to provide a sheet metal fire box of octagonal configuration in vertical cross-section wherein the bottom wall and the outwardly inclined lower sidewalls of the fire box are lined with fire brick to store and reflect heat away from the floor upon which the fireplace stove sits and to permit thermal stress to the fire box without warpage of the same.

SUMMARY OF THE INVENTION

The improved low cost fireplace stove of the present invention comprises a sheet metal fire box formed of laterally spaced, vertically extending octagonal end walls connected together at respective edges by horizontal walls. Fire brick lines the bottom wall and outwardly inclined lower sidewalls of said fire box and face upwardly. First air flow means directs air flow about the exterior of the sheet metal fire box at the rear of the stove both vertically upwards and vertically downwards from the vertical rear wall to maintain the floor between the bottom of the fire box and the floor of the building relatively cool and cause heat transfer by convection. A front window assembly overlies a transverse opening within the front vertical sidewall of the fire box and supports a tempered glass plate or window permitting viewing of the interior of the fire box from the front of the stove. Second air flow means is carried by the stove for directing combustion air flow over the rear surface of the front glass plate and towards the combustion area defined by the interior walls of the fire brick. The front window assembly may include a fixed grill extending transversely above the front glass plate and between the glass plate and the interior of the fire box and an apertured draft slide bar is slidably mounted within the front window assembly for varying the size of the openings formed by the slots of the grill and the draft slide bar. A shut-off plate of a size similar to that of the front glass window is slidably positioned within the front window frame to the rear of the front glass window for shutting off the interior of the fire box from the front glass window as desired. An elongated channel member fixed to the fire box internally of and below the front window assembly is provided with an opening which extends longitudinally in alignment with the front glass plate and at least one sliding draft plate means is mounted to a sidewall of the fire box overlying an opening within said sidewall leading to the draft channel formed between the channel member and the sidewall for permitting air to flow by convection from the exterior of the fire box, through the draft channel and over the interior of the front glass prior to reaching the combustion area of the fire box.

A vertical backsplash panel of sheet metal extends vertically upward, is spaced from and overlies the rear vertical sidewall of the fire box to form an air flow channel therebetween. Said backsplash panel rises to a height beyond the top wall of the fire box, and a motorized fan is mounted to the backsplash panel and is provided with a discharge opening for discharging air under pressure into the vertical channel between the backsplash panel and the vertical rear wall of the fire box such that air is deflected upwardly to cause heat generated within the fire box to be reflected by the backsplash panel towards the front of the stove. A second flow of air occurs downwardly along the lower rear inclined sidwall and for passage between the bottom of the stove and the floor to maintain the bottom of the fire box and the floor relatively cool.

A transverse shelf extends horizontally forward from the backsplash plate at its upper end and partially overlying the top wall of the sheet metal fire box. Backsplash bracers or rods extend upwardly from said sheet metal fire box at both ends thereof and are fixed respectively to the top wall of the fire box and to the shelf to support the shelf and brace the backsplash panel plate. The tubular flue stack which extends vertically upwardly from the sheet metal fire box projects through an opening within the shelf such that the shelf acts to further support the flue stack at a point remote from the fire box.

BRIEF DESCRIPTION OF THE DRAWINGS

FIG. 3 is a vertical sectional view of the fireplace stove of FIG. 2 taken about line 3—3.

FIG. 4 is a horizontal sectional view of the stove of FIG. 3 taken about line 4—4.

FIG. 5 is a vertical sectional view of a portion of the stove of FIG. 3 taken about line 5—5.

DESCRIPTION OF THE PREFERRED EMBODIMENT

Figure 1:
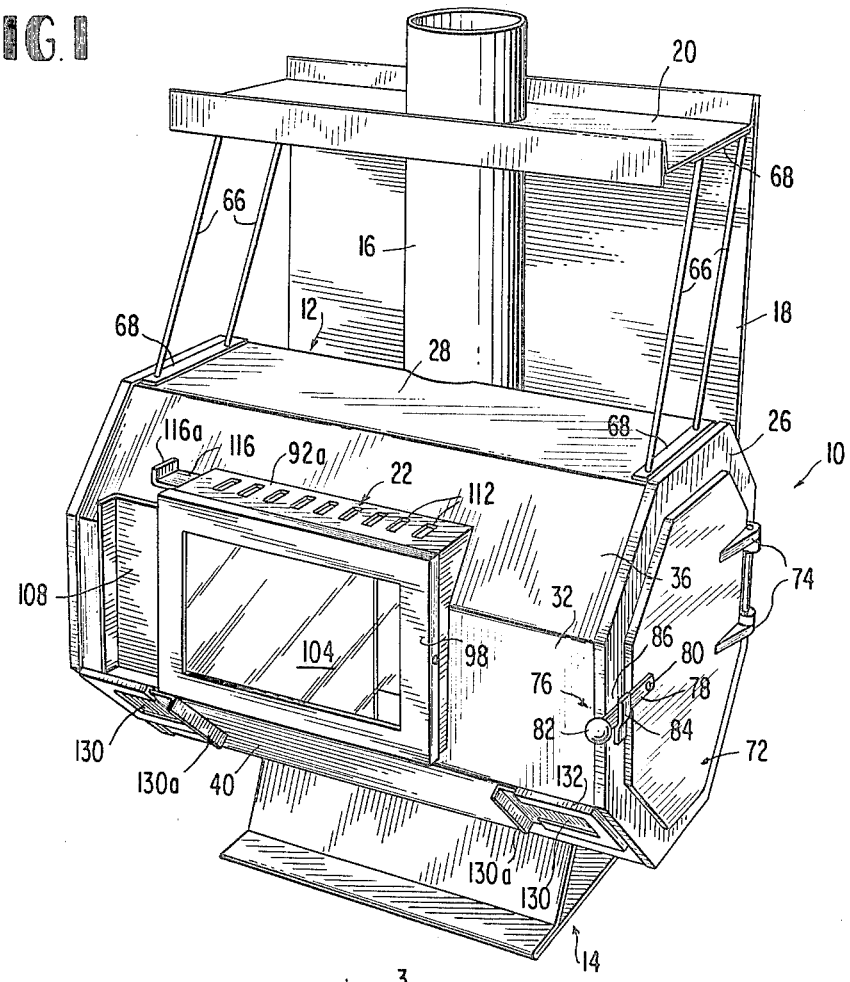
FIG. 1 is a perspective view of the improved sheet metal fireplace stove of the present invention.

By reference to the figures, a preferred embodiment of the present invention is shown. The fireplace stove of the present invention, which is shown generally at 10, comprises insofar as principal components, a sheet metal fire box indicated generally at 12, a sheet metal base or stand 14, a vertical flue stack at 16, a backsplash plate or panel 18 including an integral shelf 20, and a front window assembly indicated generally at 22. The sheet metal fire box 12, which preferably is formed of 11 gauge sheet steel, is provided with a left side, vertical end wall 24 and a right side, vertical end wall 26, the end walls being of octagonal configuration, as is the fire box 12 in vertical cross-section. The fire box 12 is completed by a plurality of transversely extending walls which are joined by being welded or otherwise affixed at their lateral ends to the octagonal end walls 24 and 26 of the fire box 12.

As may be seen in FIG. 3, the transversely or laterally extending walls comprise a horizontal top wall 28 and a horizontal bottom wall 30, a vertical front wall 32 and a vertical rear wall 34, the front and rear vertical walls 32 and 34 being joined respectively to the top and bottom walls 28 and 30 by inclined, upper front and rear sidewalls 36 and 38 respectively, and lower, inclined front and rear sidewalls 40 and 42 which extend outwardly and upwardly in oblique fashion from respective longitudinal edges of the bottom wall 30 and are joined at their upper ends to the lower ends of vertical front and rear walls 32 and 34. In fact, walls 28 through 42 may be formed of a unitary piece of sheet metal, being simply bent along parallel lines to form a hollow tube of octagonal cross-section. Alternatively, walls 28 through 42 inclusive may be formed as single elements and welded or otherwise joined together along their edges as desired.

The resultant octagonal fire box 12 is relatively rigid and will not deflect or warp under thermal stress due to temperature differential when a fire is formed within the stove. A similar structurally reinforced and thermal stress-free and warp-free fire box may be formed of a hexagonal construction, where the vertical front and rear walls 32 and 34 are eliminated and inclined upper sidewalls 36 and 38 are simply joined to the upper ends of inclined lower sidewalls 40 and 42 respectively. The fire box 12 is supported within a building and spaced from a floor F by means of a sheet metal stand or base indicated at 44 which may be formed of a unitary piece of sheet metal such as steel and in fact of the same gauge as that forming the fire box 12 and being preferably trapezoidal in vertical cross-section including extended feet 46 at its base and a flat top wall 48, upon which the bottom wall 30 of the fire box 12 rests and being fixedly attached thereto by way of rivets or the like (not shown). The upper inclined sidewall 38 is suitably apertured as at 49 as well as a portion of the top wall 28 so as to receive the lower end of a tubular flue stack 16, the aperture or opening 49 being formed within the center of the inclined upper sidewall 38 with the flue stack 16 being welded or otherwise affixed thereto and projecting vertically upwardly therefrom.

An important aspect of the present invention resides in the employment of the backsplash plate or panel 18 which may be likewise formed of sheet steel, 11 gauge or the like, and being fixedly mounted at its lower end to the vertical rear sidewall 34 by means of a pair of angle bars 50 which extend vertically upwardly within a slot 52 formed between the backsplash plate 16 and the vertical rear wall 34. The angle bars 50 being of L-shape in configuration provide structural rigidity to the assembly and also support the fan or blower indicated generally at 54, FIG. 4, which is mounted directly to the rear of the back splash plate 16 facing the vertical rear wall 34 of the fire box. The fan 54 has a casing of convolute form, upon the top of which is mounted a fan drive motor 56 whose shaft (not shown) projects through the convolute housing and carries a cylindrical blower or impeller (not shown) facing an opening (not shown) within the bottom of the fan casing which acts as an air inlet and permits air to be blown under pressure through a lateral opening within a vertical mounting plate 58 and a corresponding opening within plate 18, permitting air under pressure to enter the space 52 between the angle bars 50 for impact against the outer surface of the fire box rear wall 34. This air is deflected as seen by arrows 62, FIG. 3, upwardly and downwardly, that is, a portion of the air flows upwardly within space 52 between the rear wall 34 of the fire box and the backsplash plate 18, while another portion of the air flows downwardly between the inclined lower sidewall 42 and a similarly inclined extension portion **18*a* of the backsplash plate 18. The relatively cool air flow is passing over the bottom of the fire box passes between the fire box 12 and floor F so as to maintain the space between the fire box 12 and the floor F in the vicinity of stand 44** relatively cool, thus protecting the floor.

Figure 2:
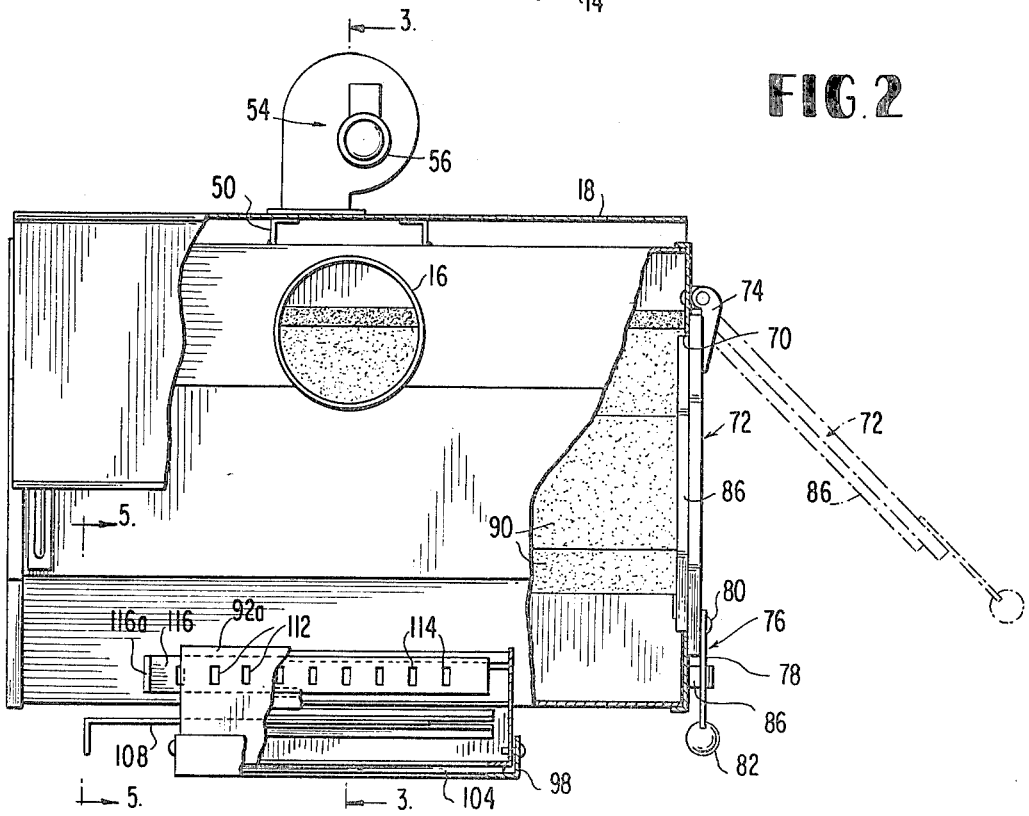
FIG. 2 is a top plan view, partially broken away, of the fireplace stove of FIG. 1.

The back splash plate 18 extends vertically upward and is generally of rectangular configuration, extending the full width of the stove 10 so as to create a large heat reflecting surface at the back of the stove for reflecting heat forwardly, that is, towards the front of the stove 10. The upper end of the backsplash plate 18 terminates in an integral shelf 20, the backsplash plate 18 being reversely bent at **18*b* to form a horizontal shelf wall and being bent again at right angles to the back splash plate 18 as at 20*a* to form the horizontal shelf 20. Shelf 20 is apertured at 64 to receive the upper end of the flue stack 16, the aperture or opening 64 being of circular configuration and being of a diameter on the order of the outside diameter of the flue stack 16 so as to closely receive the same. Further, the upper end of the flue stack 16 may be welded to the shelf 20 at this point, if desired, to improve the structural rigidity of the stove. The shelf 20 terminates in a right angle flanged edge portion 20*c* to form a retaining lip for articles stored thereon and to provide a decorative finish for the shelf. Since articles may be stored on the shelf 20 to maintain them relatively warm or in fact to warm the same if they are cool, the stove is provided with a pair of backsplash braces or rods 66 at both ends of the stove, the rods 66 being commonly mounted to bars 68** at respective ends with the bars 68 being fixed to the top wall 28 and to the bottom surface of the shelf 20 respectively. Preferably, the bars 66 extend parallel to each other and are inclined from front to rear in the direction leading from the fire box top wall 28 to the shelf 20. The right end wall 26 of the stove, FIG. 1, is provided with an octagonal opening 70 which follows the outlines of the octagonal end wall and permits access to the interior of the fire box for adding fuel to the fire box as needed, and a two ply sheet metal door 72 of similar octagonal configuration but being sized slightly larger than that of opening 70, is mounted by way of hinges 74 to the side of the end wall 26 for pivoting about a vertical axis. A door latch indicated generally at 76 takes the form of a pivotable arm 78, being pivoted at its inner end to the door 72 as by way of pin 80, and extends outwardly beyond the front wall 32 of the fire box, arm 78 carries a knob 82 at its outer end, while the end wall 26 is provided with an L-shape bar 84 which is welded at its lower end to the end wall 26 and defines a vertical slot 86 at its upper end which receives the door latch arm 78 and which presses that arm against the end wall 26 while maintaining the door in closed position. The door 72 is provided with an inner plate 86, also being of octagonal configuration and being sized slightly smaller than opening 70 within which it is fitted when the door 72 is in closed position, FIG. 2. It may be stated that, for example, that the illustrated embodiment of the invention is formed with a fire box 12 approximately 30 inches in length, that is, from end wall 24 to end wall 26, thus accepting logs for burning within the stove of approximately 30 inches.

With the octagonal configuration shown for the fire box 12 or for the construction of hexagonal configuration by the elimination of front wall 32 and rear wall 34, in each case the bottom wall 30 has from its opposite sides, outwardly and upwardly diverging sidewalls as at 40 and 42, thus defining a concave bottom for the fire box. To enhance combustion of the logs indicated at L, FIG. 3, or for coal or alternate solid fuels, the bottom wall 30 and inclined sidewalls 40 and 42 are lined on their interior with fire brick. As shown, fire brick slabs or blocks 90 extend longitudinally from end to end as seen in the various figures. The slabs 90 are of mid-temperature fire brick and form heat reflecting and insulating members, that is, they reflect the heat towards the center of the fire box and upwardly and away from the floor F, thereby insuring along with the flow of air by way of arrows 62 beneath an exterior of the fire box, a relatively cool floor area which prevents accidental overheating of the floor and objects in the vicinity of the stove 10.

The octagonal configuration of the fire box further enhances reflection of heat and circulation of air internally relative to the area of flame as created by combustion of the logs L. As with all stoves or heaters, combustion air must be continuously added to the combustion chamber as defined by the fire box to promote the flame and burning of the fuel. Further, since the present invention is directed to a fireplace stove, that is, a stove which permits the heating or cooking of food on the top wall 28 and also may be employed solely as a fireplace heater, that is, as a room heater permitting viewing of the interior of the combustion chamber where burning of the logs or other fuel takes place, the fire box of the present invention is characterized by having a front window assembly 22 which extends along a portion of the length of the fire box 12.

The front window assembly 22 is formed principally by an open rectangular or box frame or member 92, which may be formed of cast iron and which is mounted to the front wall 32 and upper inclined sidewall 36 at the front of the fire box. In this respect, the portion of the front wall 32 and the sidewall 36 is provided with an irregular rectangular opening 94, and the box frame 92 which is of somewhat inverted L-shape in vertical section, is fixedly mounted to front wall 32 and sidewall 36 at its rear be being welded or otherwise fixed thereto and forming an extension of the opening 94 within the firebox 12. The box frame 92 terminates at its forward end in a rectangular window opening 96 and cooperates with a rectangular window frame member 98 which is bolted or screwed thereto by way of bolts 100 and is provided with rectangular window opening 102 of a size similar to aligned window opening 96. Positioned between the front end of the box frame 92 and the window frame 98 is a clear, tempered glass plate or window 104 which permits the direct viewing of the interior of the fire box 12 from the front of the stove. Further, the box frame 92 is provided with a pair of oppositely directed L-bars 106 defining guides at the top and bottom which extend horizontally and form upper and lower guide slots for a planar, opaque shut-off plate 108 which slides through a vertical opening or slot 110, FIG. 4, within a sidewall of the box frame member 92 on the left side thereof. The shut-off plate 108 is bent at right angles at that side as at 108*a* to form a handle to permit the shut-off plate 108 to be manually slid into and out of the front window assembly for closing off the view of the interior of the combustion chamber or fire box 12 by way of the clear glass plate 104. With the shut-off plate 108 removed, however, the view of the burning logs L is unobstructed.

Further, the upper horizontal top wall 92*a* includes a plurality of rectangular openings or slots forming a grill and cooperating with a draft slide bar indicated generally at 116 which slides beneath the grill and is provided with a similar series of rectangular slots 114 which match with slots 112 and permit a variable flow rate of air to pass into the fire box 12 and downwardly across the inner face of glass plate window 104. Unlike the shut-off plate 108, the draft slide bar 116 whose outer end is also bent at right angles as at 116*a* to form a handle for the slide bar, is never fully removed from the slot within the vertical sidewall of the box frame 92 which receives the same and from a slideway defined by a bent edge portion 36*a* of the sidewall 36 and a guide member 118 but is simply shifted a short distance to either close off completely the grill openings 112 or to align those grill openings fully or partially with the slots or openings 114 within the draft slide bar 116.

In order to further insure that the inner surface of the glass plate 104 remains relatively cool and to provide sufficient air and proper air flow relative to the logs L or other fuel to be burned as it rests upon the fire brick slabs 90, the present fireplace stove of the present invention is advantageously provided with an L-shape channel member 120 which extends between the end plates 24 and 26 and is spaced from the lower front sidewall 40 so as to form an air flow channel 122 which underlies the front glass window 104. Further, the lower inclined front sidewall 40 of the fire box is provided with a pair of rectangular air draft openings 124, FIG. 4, adjacent respective end walls 24 for permitting air to enter the horizontal channel 122 and for flow to a central rectangular slot 128 within the horizontal upper wall of the L-shape channel member 120 and so direct air flow as indicated by arrows 138 against the rear surface of the glass window 104, assuming that the shut-off plate 108 has been removed from its slot. The volume of air flow which moves by natural convection may be readily varied by means of the sliding draft plates indicated generally at 130 which are slidably mounted by way of the U-shape sheet metal guides 132 which are fixed to the front surface of the lower front sidewall 40 and surround the rectangular openings 124 within that member, FIG. 5. The sliding draft plates terminate in right angle bent portions or gripping handles 130*a*, the draft plates being slid towards each other to expose a larger portion of the rectangular openings 124 within the inclined, lower sidewall 40 of the fire box 12. It should be noted that by way of the channel 122, the elongated slot 128 and openings 124 within the inclined sidewall 40, air flow is promoted over the inner surface of the tempered glass window 104 to cool the window, and to direct air to the area of the logs L above the fire brick slabs 90 constituting the flame area for the stove.

Further, additional air may be selectively directed downwardly by way of the grill openings 112 and slots 114 within the draft slide bar to further cool the glass plate 104 and to facilitate a proper oxygen flow to the combustion area. The natural convection of air into the openings 124 at each side of the front window assembly 20 and over the inner surface of the glass plate 104 further tends to maintain the bottom of the stove relatively cool along with the induced air flow provided by fan assembly 54 through channel 52 as indicated by arrows 62. The combustion air is delivered to the fuel in such a manner that it first cools the glass 104 and then hits the fire near the base of the flame where it promotes combustion to a maximum extent, thus providing a fireplace heater and stove having high efficiency, of relatively cheap construction, and in form of a sturdy appliance requiring minimum maintenance. The utilization of a backsplash plate or panel which rises from the rear wall and acts in conjunction with that rear wall to form a confined air flow area for forced air entering the space by way of the power driven blower or fan causes the base of the fire box to remain cool during operation and promotes by way of convection and reflection, the heating of the room in a direction away from the back splash plate towards the front of the stove. At the same time, the backsplash plate or panel permits the fireplace stove to be placed closer to a wall of the building as well as improving the attractiveness of the stove, particularly by the addition of the unitary shelf 20.

While the invention has been particularly shown and described with reference to a preferred embodiment thereof, it will be understood by those skilled in the art that various changes in form and details may be made therein without departing from the spirit and scope of the invention.

What is claimed is:

1. An improved fireplace stove for heating a building or the like comprising:

a sheet metal fire box, said fire box comprising laterally spaced, vertically extending sheet metal end walls, said end walls being of polygonal shape, and vertically spaced top and bottom walls extending horizontally between said end walls, a vertical rear wall extending between said end walls, front and rear lower inclined sidewalls extending between said end walls and being inclined upwardly and outwardly from respective edges of said horizontal bottom wall, said rear lower inclined sidewall being joined to the lower edge of said vertical rear wall, a rear upper inclined sidewall extending between said end walls and being inclined downwardly and rearwardly from the edge of said top wall and being joined thereto to the upper edge of the rear wall, fire brick lining the inner surface of said bottom wall and at least portions of adjacent inclined lower sidewalls, a flue stack fixed to said sheet metal fire box, being open to the fire box interior at the bottom thereof and extending vertically above said top wall at the rear of said stove, a metal backsplash plate fixedly mounted to the rear of said sheet metal fire box and spaced therefrom and extending vertically upwardly above said fire box top wall and including an inclined portion facing the lower rear inclined sidewall and forming on the exterior of said sheet metal fire box a heated air flow path for air flow upwardly and away from said backsplash plate to convect heat toward the front of the stove and the flow of relatively cool air beneath the sheet metal fire box to maintain the bottom of the fire box cool, fan means for forcing air between said sheet metal fire box and said metal backsplash plate and for forcibly causing air to flow upwardly and away from the back splash plate and downwardly beneath said sheet metal fire box, means for introducing combustion air flow into the interior of the sheet metal fire box at said lower front inclined sidewall to further cool the bottom of the sheet metal fire box during operation of said stove, and door means carried by said sheet metal fire box permitting access to the interior and placing of solid fuel onto said fire box for maintaining a fire therein.

2. The fireplace stove as claimed in claim 1, wherein the front of said sheet metal fire box carries a hole therein, and further comprising a front window assembly mounted to the front of the sheet metal fire box between said inclined lower sidewall and said top wall, said front window assembly comprising a box frame member mounted to the sheet metal fire box and surrounding said hole therein and a rectangular metal front window frame fixedly mounted to the box frame and defining a window opening therein and a tempered transparent glass window mounted within said window frame for viewing the burning fuel within the interior of the sheet metal fire box.

3. The fireplace stove as claimed in claim 2, further comprising at least one draft opening within said front lower sidewall, a sheet metal channel member mounted within said sheet metal fire box facing said lower inclined front sidewall and forming with said front sidewall an elongated draft channel and open to said at least one draft opening, said channel member including an elongated slot in alignment with said front window assembly such that air introduced into said draft channel through said at least one draft opening within said lower front inclined sidewall passes vertically upward over the rear of said transparent glass window for cooling the window prior to being deflected towards the interior of the fire box and fuel resting upon said fire brick lining.

4. The fireplace stove as claimed in claim 3, wherein said box frame includes a plurality of longitudinally spaced slots within a top wall overlying said window, and a draft slide bar is slidably mounted within said box frame throughout the length thereof underlying said box frame top wall and in parallel with said box frame top wall, and said draft slide bar includes a plurality of similarly shaped and similarly sized and spaced slots such that shifting of said draft slide bar longitudinally relative to said box frame permits the slots of said box frame and said slide bar to be aligned to create second air draft passages in opposition to that created by the draft channel opening for passage of cool combustion air over the inner surface of said transparent glass panel or plate window for cooling of the same.

5. The fireplace stove as claimed in claim 4, wherein said fire box is octagonal in vertical cross-section and further includes a vertical front wall and an upper front inclined sidewall wherein both said upper front and rear inclined sidewalls extend from respective edges of the top wall downwardly and outwardly to the upper ends of the vertical front and rear walls, respectively, said box frame is fixedly mounted to said front wall and said backsplash plate is fixedly mounted to said rear wall, and said fan means comprises a motor driven fan assembly mounted to the rear of the backsplash plate and having an air discharge passage which opens to the space between the backsplash plate and the rear wall of the sheet metal fire box for causing forced air to move vertically upward between the backsplash plate and said rear wall of said sheet metal fire box and to move downwardly for passage under the bottom of the sheet metal fire box to maintain the same relatively cool.

6. The fireplace stove as claimed in claim 5, further comprising a sheet metal stand of hollow trapezoidal configuration including a flat upper wall fixedly mounted to and extending parallel with the bottom wall of the sheet metal fire box to permit said stove to be mounted in upstanding position on the floor of the building to be heated.

7. The fireplace stove as claimed in claim 6, further comprising an elongated vertical slot within the sidewall of said front assembly box frame to the rear of the front window, and an L-shape shut-off plate slidably extending through said vertical slot and being slidably mounted within said box frame for selective movement to shut off selectively the view of the interior of the fire box by way of said glass plate window.

8. The fireplace stove as claimed in claim 7, wherein said backsplash plate terminates at its upper end in an integral sheet metal shelf extending generally at right angles to the portion of the backsplash plate and extending upwardly from said fire box rear wall, said shelf being apertured to receive the flue stack and acting as a support for the same and a pair of backsplash brace rods extending upwardly from both sides of the top wall of said sheet metal fire box and fixed at their lower end to the fire box and at their upper end to said sheet metal shelf for reinforcing the shelf and for rigidly locating the upper end of the backsplash plate.

* * * * *